United States Patent [19]

Boegli et al.

[11] 4,185,645

[45] Jan. 29, 1980

[54] PRODUCTION OF CIGARETTE FILTER UNITS

[75] Inventors: Serge Boegli, Zurich; Jean-Pierre Lebet, Montreux, both of Switzerland

[73] Assignees: F. J. Burrus & Cie, Boncourt; Baumgartner Papiers S.A., Crissier, both of Switzerland

[21] Appl. No.: 926,797

[22] Filed: Jul. 21, 1978

Related U.S. Application Data

[63] Continuation of Ser. No. 748,500, Dec. 8, 1976, abandoned.

[30] Foreign Application Priority Data

Dec. 8, 1975 [CH] Switzerland ..... 15905/75
Nov. 26, 1976 [CH] Switzerland ..... 14907/76

[51] Int. Cl.[2] ..... A24C 5/50

[52] U.S. Cl. ..... 131/261 R; 93/1 C; 93/77 FT

[58] Field of Search ..... 93/1 C, 77 FT; 131/261 R

[56] References Cited

U.S. PATENT DOCUMENTS

| | | | |
|---|---|---|---|
| 3,370,592 | 2/1968 | Schultz et al. | 93/1 C X |
| 3,482,488 | 12/1969 | Sexstone | 93/1 C |
| 3,762,281 | 10/1973 | Burrus et al. | 93/1 C |
| 3,807,286 | 4/1974 | Sexstone | 93/77 FT X |

*Primary Examiner*—Robert D. Baldwin
*Attorney, Agent, or Firm*—Ernest F. Marmorek

[57] ABSTRACT

Cigarette filter units are made in a long strip with alternate portions of fibrous and pourable filter material. The fibrous portions are first attached at spaced intervals to a sheathing strip which is wrapped practically right around them to form a cylinder with regular empty spaces between the fibrous portions and openings into the spaces. In a special unit, air is extracted from these spaces so that when the spaces enter a chamber containing pourable filter material, they suck the material in to fully fill the spaces. Excess filter material is brushed off the filter unit, and a sealing strip is stuck over the openings.

30 Claims, 16 Drawing Figures

39

38
4

37
4
10

35

18
10

14
10
1

13
10

12
1
10
11

7
9

4
7
8

5
6
4
XII
XI
X
IX
VIII
VII
VI
V
IV
III
II
39
38
37
35
15
14
13
11
10
9
8
1
4

PRODUCTION OF CIGARETTE FILTER UNITS

This is a continuation, of application Ser. No. 748,500, filed Dec. 8, 1976, now abandoned.

The present invention relates to a method for producing cigarette filters in units in which portions of fibrous filter material and of pourable filter material are serially disposed so as to form a continuous length of filter material.

The invention extends to apparatus for performing the method, and to a cigarette filter unit produced in accordance with the method.

The units produced in accordance with this invention will subsequently be subdivided into individual cigarette filters.

The prior art for example Burrus et al., U.S. Pat. No. 3,762,281 already discloses a method for producing a cigarette filter unit in which the sheathing strip for forming the chambers that are to be filled with pourable filter material is placed in U-configuration around the filter elements and the filling part between the members of the U-shaped sheathing strip bears sealingly on oppositely disposed inwardly orientated side surfaces of the U-shaped sheathing strip on the top sides of the filter elements which move forward with the sheathing strip. These methods suffer from the disadvantage that almost the entire top half of the filter elements, which have a rough surface, is blackened by the granulated filter material, usually comprising activated carbon, such blackening being difficult to remove, and granulate particles enter into the converging gaps formed between the inside of the U-shaped sheathing strip and the filter elements and are adhesively fixed at that place after complete closure of the chambers. As a result, black traces of dusty filter material become visible on the cut surfaces of the cigarette filter units along the external circumference thereof when the tube, comprising portions which consist of filter elements and pourable filter materials, are subdivided into individual cigarette filter units and sometimes, due to blackening of the cutting knife, black traces of dusty filter material become visible on the cut surface itself and granulate particles, fixed between the outside of the filter elements and the sheathing strip, are exposed, such granulate particles then dropping out when the cigarette is subsequently smoked to reach the mouth of the smoker, a feature which is very unpleasant. Furthermore, by using this known process it is not possible to produce very short chamber filters because the length of the filter element of such filters and therefore their support surface becomes so short that due to friction with the sliding part which is associated with the filling station and bears on the entire top half of the filter elements the latter are torn away. With the known method it is therefore always necessary for the length of the individual filter elements disposed on the sheathing paper to be at least twice as long as their diameter so that it is impossible with this known method to produce filter units of a length of less than approximately 19 mm because the diameter of most cigarette filters is approximately 8 mm and the chamber length must be at least 4 mm if a sufficient amount of granulate is to be filled in.

The prior art for example Sexstone, U.S. Pat. No. 3,482,488, also discloses a method for producing a cigarette filter unit in which two sheathing strips are required, the inner perforated sheathing strip however does not extend over the entire circumference of the filter elements which consist of cellulose or acetate. The outer sheathing strip must be introduced between the conveyor belt and the filter elements to be sheathed simultaneously with the inner sheathing strip, and the width of the outer strip must be greater than the circumference of the filter elements which are to be sheathed, so that after completed filling of the chambers it is wrapped around to form a second sheathing which completely surrounds the previously formed strand, and is adhesively joined thereto so that the filling and perforation apertures are closed. In this process air is drawn through the perforated internal sheathing strip from the chambers which are to be filled with pourable filter material but since the top of these chambers is completely open it is not possible to produce a substantial negative pressure through the perforations in the chambers which are to be filled. Furthermore, it is not possible in this process to employ a conveyor belt in the suction region which supports the filter strand and simultaneously performs a conveying action as this would prevent suction being applied from below so that no substantial negative pressure could be applied by the suction part which acts from below since otherwise the internal, forward-moving sheathing strip would be excessively thrust upon the stationary support part and would thus be decelerated. This process is relatively complicated and calls for two sheathing strips.

A sheathing strip with relatively small filling ports is used in another known method for example Sexstone, U.S. Pat. No. 3,807,286, the width of said strip corresponding to the filter elements which are to be sheathed, the granulate being filled into the chambers by intermittent operation through the filling ports formed in the sheathing strip. However, such a process is far too slow in the mass-production of cigarette filter units and synchronization between the production of filling ports in the sheathing strip and the position of the chambers to be filled as well as synchronization between the granulate supply ducts and the filling ports in the sheathing strip is exceptionally difficult to perform in practice. Furthermore, resetting of the apparatus for the production of a cigarette filter unit of a slightly different length is also very complicated because different parts of the machine must be exchanged because of the different distance from the filling ports and synchronization of different motions must be differently adjusted and regulated. Evacuation of the chambers to be filled either before or after the filling operation is possible only by using a perforated sheathing strip as in the previously mentioned known method, but with the same disadvantages mentioned in relation thereto, i.e. an outer second sheathing strip with a width greater than the diameter of the filter strand to be sheathed has to be used.

It is the purpose of the invention to provide a method which permits the production of cigarette filter units which are filled with pourable filter material. The term "pourable filter material" includes the use of coarse-grained as well as pulverized filter material.

According to the invention there is provided a method for producing cigarette filter units as described hereinbefore, wherein a continuous suction slot of constant width is formed which extends along the entire filter strand and is defined by lateral suction slide surfaces and filler part slide surfaces, filler openings are also formed of constant width extending over the entire distance between the individual filter elements, through said filter elements being sheathed with a sheathing strip before the chambers are filled with pourable filter material, the sheathing strip width amounting to between 75 and 93% of the circumference of the filter element.

Use of the method according to the invention permits operation at very high speeds, i.e. at speeds of up to 60 m/min (corresponding to the production of 50 to 67 granulate-filled chamber filters per second), to produce very short chamber filters with fully filled chambers and without damaging the circumferential surface of the individual filter elements and without the presence of pourable filter material between the circumferential surface of the filter elements and the sheathing strip.

The invention also relates to apparatus which is provided with fastening means for the spaced fastening of the individual filter elements on the sheathing strip, a forming part, which is disposed in the region of guiding and conveying means for the sheathing strip with filter elements, and which places the sheathing strip during its forward motion around the filter elements affixed to it, a filling part for filling the chambers formed between the individual filter elements with pourable filter material, a closing system for closing the filling parts of the chambers filled with pourable filter material and with separating means for subdividing the tube, comprising fibrous filter elements and pourable filter material, into portions of specific length and is characterized in that the device for forming a suction slot of constant width, defined by lateral suction and filling part slide surfaces and extending along the entire filter strand and for forming filling ports of constant width over the entire distance between the filter elements is provided with sheathing means which sheath the filter elements, except for the suction slot, with a sheathing strip whose width is at least 75% but not more than 93% of the circumference of said filter elements, and are joined to said filter element so that the two side edges of the sheathing strip define the suction slot and the filling ports laterally; that firstly a suction part and then a filling part bear slidingly and sealingly on the top sides of the filter element exposed between oppositely disposed side edges of the sheathing strip placed around the filter element as well as on suction and filling part slide surfaces of the sheathing strip, namely above the guiding and conveying means on the top side of the filter strand and downstream of the sheathing means as seen in the conveying direction of the filter strand, said suction part and filling part extending into a suction slot which is thereby formed, and by the provision of a closing system which closes the suction slot by means of a sealing strip, the width of which is slightly greater than the width of the suction slot.

It is advantageous that between the suction part and the filling part is a common slide surface which bears sealingly on the exposed top sides, not covered by the sheathing strip, associated with the filter element that moves forward with the sheathing strip and the two suction and filling part slide surfaces which are associated with the sheathing strip and define the suction slot, so that the suction part produces a negative pressure in the chambers, which are to be filled, through the supply port which is associated with the chambers and is formed by the suction slot and is formed in the axial direction through the filter element which moves against the filling port of the filling part. To this end it is advantageous that the slide surface is formed by an elongated slide part which extends in the direction of movement and whose width exceeds that of the suction slot. It is also advantageous if the distance between the suction part suction region, situated in the slide surface and the filling port of the filling part exceeds the length of the chamber formed between filter elements.

If filter elements with a different suction resistance in the longitudinal direction are arranged successively in an alternating configuration on the sheathing strip, for example filter elements of cellulose and those of acetate, it can be advantageous for uniform filling of the chambers with specific kinds of granulate or powders if the length of the slide surface, situated upstream of the filling port of the filling part, as seen in the direction of movement of the sheathing strip, amounts to at least $2a+2b+2c$, where a is the length of one kind of filter element, b is the length of the other kind of filter element and c is the length of the chamber which is to be evacuated and the suction part extends into the slide surface at half the length thereof.

The subject of the invention also relates to a cigarette filter unit produced by the method according to the invention and the use of the said cigarette filter unit for the production of filter cigarettes.

Since the suction system of the apparatus according to the invention bears slidingly on the two continuous side edges of the sheathing strip these parts, moving relative to each other, are reliably sealed when negative pressure is applied.

One embodiment of apparatus according to the invention is explained hereinbelow by reference to the accompanying drawings in which.

Figure 13:
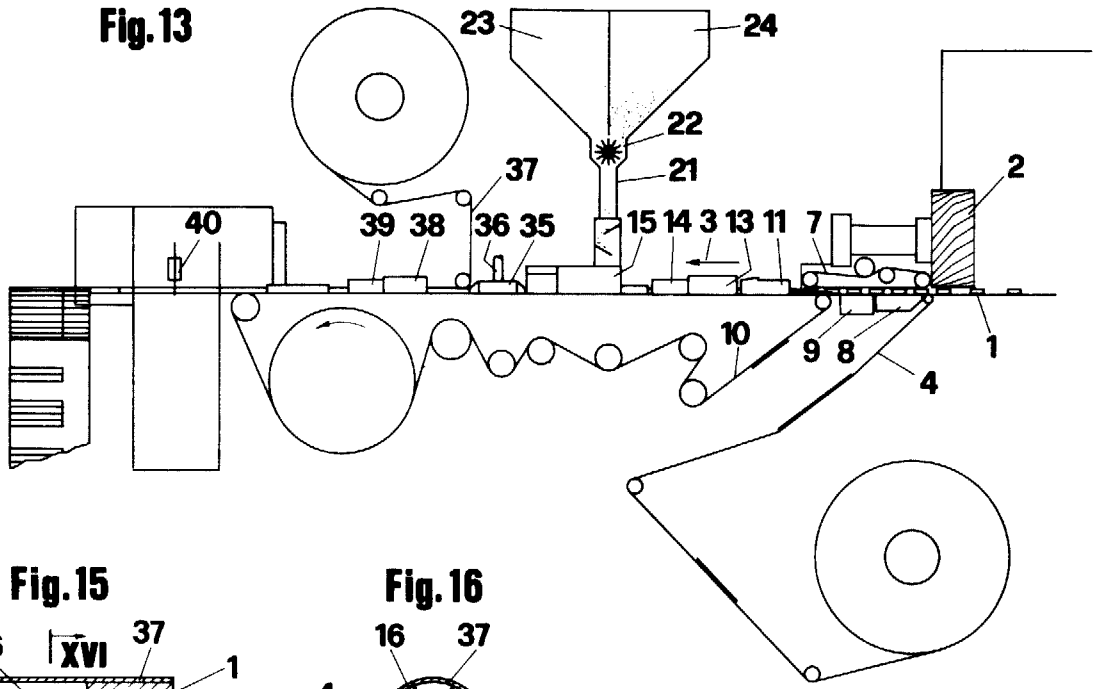
FIG. 13 is a diagrammatic side view of the apparatus.
Figure 16:
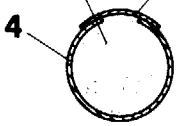
FIG. 16 is a section along the line XVI—XVI of FIG. 15.
Figure 15:
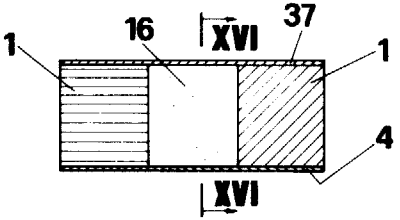
FIG. 15 is a longitudinal section through a cigarette filter unit produced by means of the apparatus illustrated in FIG. 13.

As can be seen, more particularly by reference to FIG. 13, the filter elements 1, consisting of cellulose or acetate, are moved forward in the direction of the arrow 3 and are simultaneously brought to a uniform distance from each other by means of a conveying and spacing device 2 which aligns the filter elements 1 axially with respect to each other in an alternating configuration.

Figures 1, 2, 3, 4, 5, 6, 7, 8, 9, 10, 11, 12:
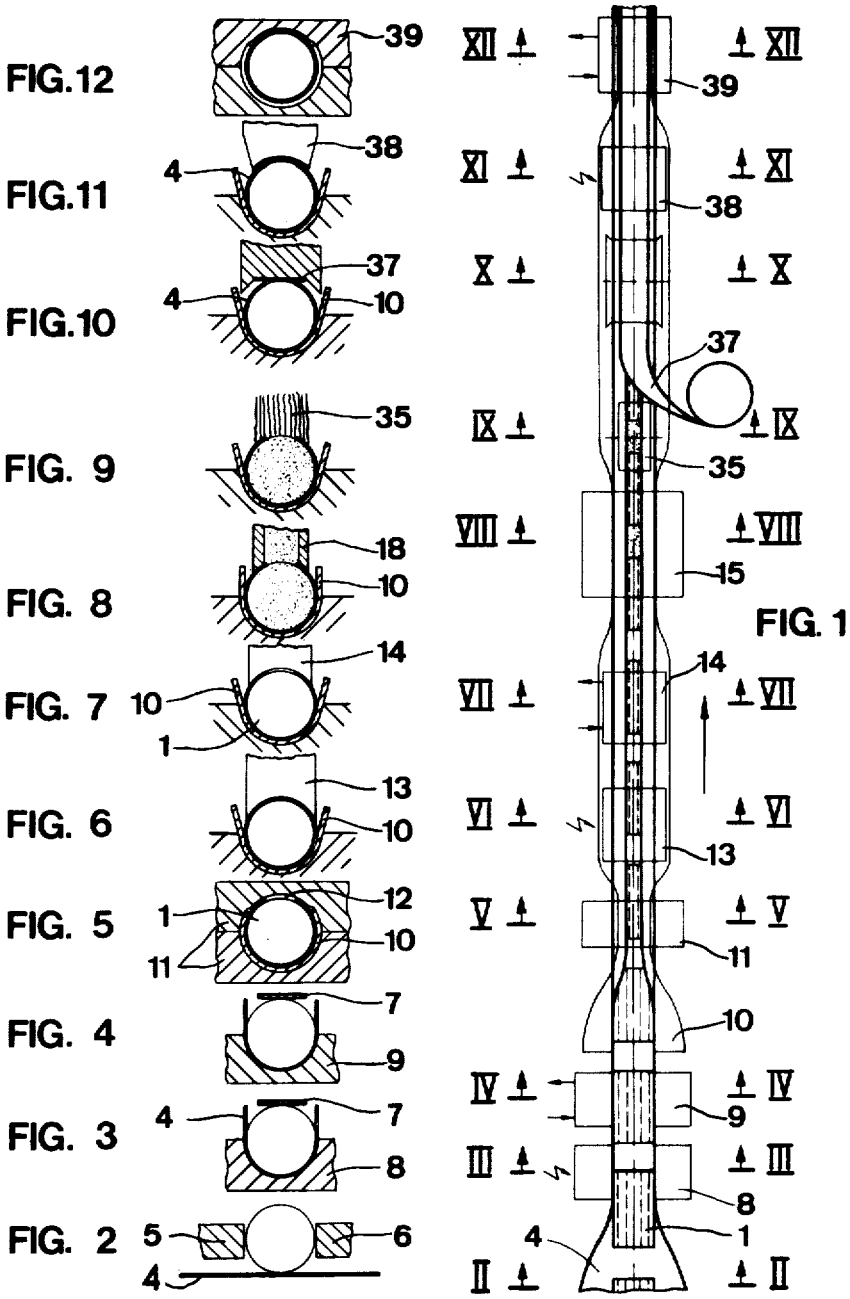
FIG. 1 is a diagrammatic plan view of the apparatus illustrated in FIG. 13.
FIGS. 2 to 12 show different sections along the lines II—II to XII—XII of FIG. 1.

According to this method, the uniformly spaced filter elements 1 which are axially aligned to each other are supplied continously to a mouthpiece sheathing strip 4, which is also supplied continuously, are placed upon said sheathing strip and, as can be seen by reference to FIG. 2, are guided laterally through guiding parts 5 and 6 and held in their relative position by means of a pressure belt 7, disposed above the mouthpiece sheathing strip 4 and circulating in synchronism therewith, so that the said filter elements are moved forward together with the mouthpiece sheathing strip 4.

On the side nearest to the filter elements 1 the mouthpiece sheathing strip 4 is coated with an adhesive which can be softened by heat, for example with a thermoplastic material, so that the individual filter elements can be secured on the sheathing strip 4 by means of a heating element 8 immediately after being transferred thereto so that relative displacement, i.e. a change of the spacing between the filter elements, is prevented. As can be seen by reference to FIG. 3, the heating element can be pressed from below against the sheathing strip 4 and can thus be indirectly pressed against the filter elements 1 which are to be secured. Advantageously, the temperature of the heating element 8 is thermostatically controlled. The heating element 8 is arranged to be lifted off the stationary sheathing strip 4 to prevent burning of the latter. On leaving the heating element 8 the sheathing strip 4 is guided over a water-cooled part 9, so as to solidify the plastics coating, previously softened by the heating element 8, to effect fixation of the filter elements 1 on said sheathing strip 4.

After securing the individual filter elements 1 on the sheathing strip 4, the strip is guided to an endless conveyor belt and both parts enter a two-part forming unit 11 in which the sheathing strip 4 of between 21 and 22 mm width is placed around filter elements 1, which have a circumference of 25 mm, so as to form a filling slot 12. This operation is performed in the course of the forward motion of the sheathing strip 4. To effect complete adhesive fixing of the sheathing strip 4 to the filter elements 1 and to obtain an accurately defined diameter for the filter, the above mentioned assembly is first guided beneath a second heating element 13, which covers the top half of the strand, and immediately thereafter is guided beneath a second cooling element 14, which also covers the top half of the strand.

Figure 14:
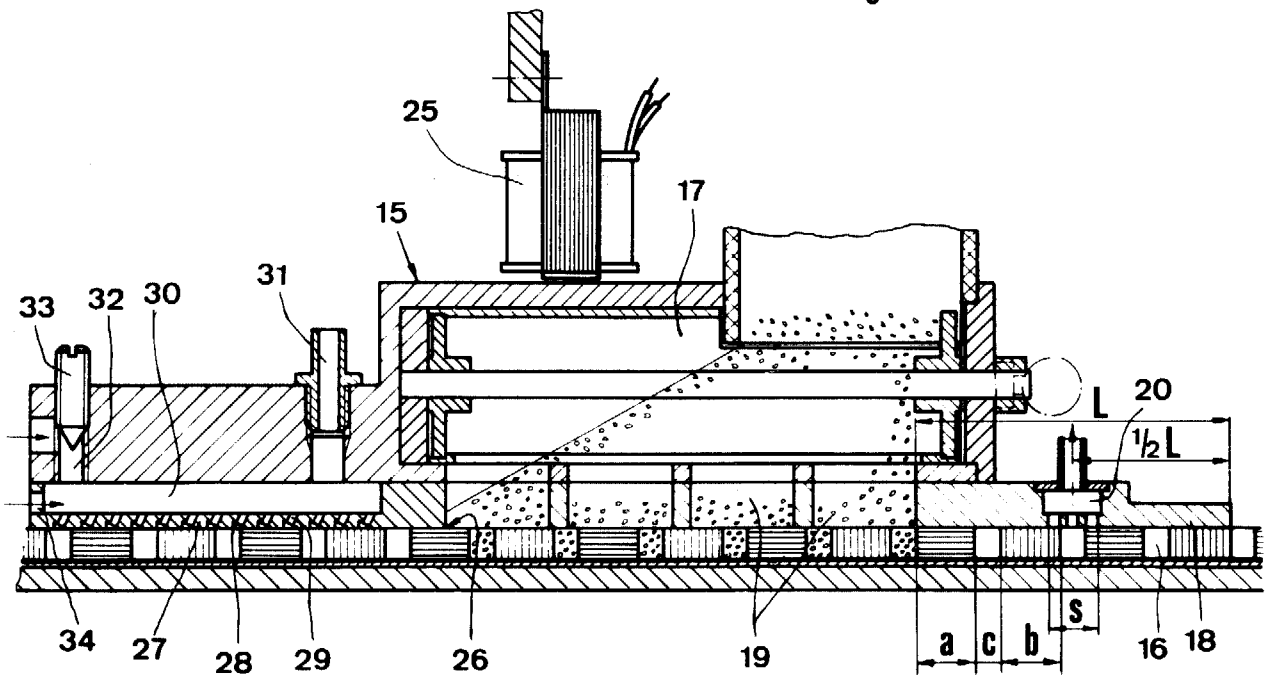
FIG. 14 is a longitudinal section through the filling station of the apparatus illustrated in FIG. 13.

The strand thus formed is then transferred by a conveyor belt 10 to a filling part 15, shown in FIG. 14, so that pourable filter material, e.g. activated carbon, can be poured into the chambers 16 formed between the individual filter elements 1. To increase the amount of pourable filter material which can be filled into the chambers 16, the downwardly orientated exit side of the storage container 17 of the filling part 15 is connected, as can be seen by reference to FIG. 14, to a suction device 20 situated upstream of the filling port 19 of the filling part 15 as seen in the direction of motion of the sheathing strip 4. The connection is via a sliding part which bears sealingly on the side edges of the sheathing strip 4 and on the exposed circumferential regions of the filter elements 1 disposed therebetween.

The distance between the suction port 20, situated in the sliding surface, and the filling port 19 is greater than the length c of the chambers 16 formed between the filter elements 1 so that in the course of the forward motion of the latter these are completely closed between the suction port 20 and the filling port 19 so that the suction system 20 can evacuate the chambers 16 from above through the filling slot 12 and can then maintain them in the evacuated state by the ensuring suction action through the filter elements 1 in the longitudinal direction thereof.

In practice, the two filter elements 1 which define the ends of a chamber 16 frequently comprise two different filter materials, one consisting of cellulose and the other of acetate. As a consequence two successive filter elements 1 have a substantially different flow resistance along their axial orientation. To prevent the different flow resistance resulting in different evacuation of the individual chambers 16 and therefore in different filling with pourable filter material, the length L of the sliding surface of the sliding part 18 situated upstream of the filling port 19 as seen in the direction of motion of the sheathing strip 4, amounts to at least $2a+2b+2c$, where a is the length of the filter element consisting of cellulose, b is the length of the adjacent filter element consisting of acetate and c is the length of the chambers 16 which are to be evacuated and are to be subsequently filled with pourable filter material. The suction region 20 provided in the sliding surface of the sliding part 18 is arranged at $\frac{1}{2}$ L for reasons of symmetry and the length S of the suction region 20 is smaller in the direction of movement of the sheathing strip 4 than the minimum length a or b of the filter elements 1 so that identical flow conditions prevail from the chamber 16 to be evacuated and situated directly beneath the suction region 20 towards both sides in the axial direction.

The chambers 16, thus evacuated, subsequently pass beneath the filling port of exit slot 19 of the storage container 17, whereupon the pourable filter material, disposed in the storage vessel is drawn suddenly into the chambers 16 which emerge from beneath the sliding surface 18. As can be seen by reference to FIG. 13 the storage vessel 17 is connected through a socket 21 and a metering device 22 to two storage containers 23 and 24 for accommodating two different kinds of pourable filter material.

To assist filling of the chambers 16 and downward sliding of the pourable filter material in the storage vessel 17 and in the exit slot 19 in the downward direction the filling part 15 is provided with a vibrator 25 which ensures that the filling part 15 vibrates at a frequency of 100 Hz in a vertical plane. A supply of compressed air can also be connected to the pipe 21, the top of which is closed by the metering device 22, so that downwardly acting pressure is additionally applied from above to the granulate which is situated in the pipe 21 and in the storage vessel 17.

An approximately semicircular stripper edge 26 is provided at the end of the exit slot 19 to define the cross-section of the passing filter elements 1 from above and to strip off excess pourable filter material. The said stripper edge 26 is situated on a stripper part 27 the underside of which is additionally provided with crescent-shaped transverse flutes 28 which strip off and take up any granules of the pourable filter material which are still present on the filter elements 1 and on the side edges of the sheathing strip 4. To remove any granular or dusty filter material which may still be present in the individual transverse flutes 28 the latter are connected through suction ports 29 to a common chamber 30 which in turn is connected through a suction line 31 to a source of vacuum and on the other hand communicates with atmosphere through a port 32, the cross-section of which can be varied by means of an adjusting screw 33, in order to adjust the degree of negative pressure. To achieve a constant minimum air flow in the chamber 30 for the reliable removal of filter material which has entered the chamber 30 the latter also communicates with the ambient atmosphere through a non-closable port 34 which is provided at its end.

As can be seen by reference to FIG. 13, a stripper brush 35, adapted to rotate about a horizontal axis is disposed downstream of the filling part 15 to remove any undesirable dust coating which sometimes remains after filling of certain pourable filter materials and is deposited on the surface regions of the filter elements exposed between the side edges of the sheathing strip 4 and on the sheathing strip side edges and causes blackening thereof. Dust agitated by the stripper brush 35 is extracted by a suction duct 36 which produces an air draught in the stripper region of the brush. A milling cutter which slightly mills the blackened surface regions of the filter elements and of the sheathing strip side edges can be used in place of a brush 35.

A sealing strip 37 the width of which is slightly greater than the width of the filling slot 12 is supplied from above downstream of the stripper brush 35, is placed over the filling slot 12 and is adhesively affixed by means of a heatable element 38 on the freely exposed surface of the filter elements 1 and on the side edges of the sheathing strip 4, namely by softening of the thermoplastic coating of the sealing strip 37. This said heatable element 38 is mounted so as to be upwardly pivotable so that it can be lifted off the stationary sealing strip 37 when the apparatus is at rest.

To obtain a precise external shape for the cigarette filter units the strand, provided with the heated sealing strip 37, is passed beneath a water-cooled cooling part 39 where the softened thermoplastic coating of the sealing strip 37 solidifies.

After the filter strand is sealed it is supplied to a cutting device 40 where it is subdivided so that the length of each filter structure amounts to four or six times the length of a single filter intended for a cigarette.

A sealing strip of transparent material which permits visual inspection into the chamber of the finished filter can be used to provide good and easy inspection facilities regarding the rate at which the chambers are filled with pourable filter material and thus providing means for inspecting the correct adjustment of the filter production apparatus.

Frequent attempts have been made to provide cigarette filters containing chambers with a filter granulate with a transparent sheath but this was hitherto impossible because in all known methods either the filter chambers were badly filled with the filter granulate and/or it was impossible to ensure that a relatively large quantity of granulate was not jammed between the transparent sheathing strip and the external surface of the filter elements, both features being unsuitable in practice for visual reasons. If granulate passes between the sheathing strip and the external surface of the filter element it results in another very detrimental disadvantage in that granulate particles from the cutting place of the cigarette filter on the mouth side frequently pass into the mouth of the smoker when the cigarette is being smoked, a feature which is of course very unpleasant.

These previously mentioned disadvantages resulted in no chamber filter containing granulate being marketed with a transparent sheath despite the existence of a demand for such filters.

The method according to the present invention for the first time makes it possible to produce chamber filters with a transparent sheath in which the chambers 16 are filled with pourable material and for such filters to be produced in reliable quality, i.e. with chambers 16 which are completely filled with pourable filter material and which have completely clean external surfaces of the filter element. This means that no pourable filter material is situated between the external surfaces of the filter elements 1 and the sheathing strip 4 of transparent material in the finished cigarette filter unit because the said sheathing strip is fixedly joined to the filter elements 1 before the pourable filter material is filled into the filter chambers 16 and the relatively narrow filling zone can be cleaned of any traces of pourable filter material in simple manner before the sealing strip 37 is adhesively affixed.

Since certain adhesives which are very suitable for adhesively joining the sealing strip 37 leave visible traces, it is advisable for visual reasons when using such adhesives to employ a sealing strip 37 of opaque material so that the adhesive joining of the sealing strip 37 is not visible and only the sheathing strip 4 is made of transparent material, for example polypropylene, polyvinylchloride or a cellulose acetate film.

If the adhesive joining is not visible it is of course advantageous if the sheathing strip 4 and sealing strip 37 both consist of transparent material.

When using a transparent sheathing strip 4 it is desirable to use pourable filter material of which at least part discolours under the effect of specific constituents in the smoke, in particular those which are a health hazard to the smoker. For example, iron salt is coloured dark by absorbing hydrogen sulphide.

When using a transparent sheathing strip it can also be advantageous to employ a pourable filter material whose parts, which are discoloured under the influence of specific constituents in the smoke which are a health hazard to the smoker, contain a composition which will at least partially but preferably entirely retain the harmful constituents chemically and/or convert them into constituents which do not present a health hazard.

Many different materials may be used for the pourable filter portion. For example, coloured granular activated carbon, or activated carbon which has a chemically non-injurious coloured coating are suitable, although it will be appreciated that this does not change colour. Alternatively, a friable filter material which contains an acid-base indicator which undergoes a colour change under the influence of an acid or a base is suitable as a material which will change colour. Other pourable filter materials are types which contain a catalyst for the oxidation of carbon monoxide to carbon dioxide. A suitable oxidation catalyst is anhydrous manganese dioxide, and, if desired, this may be mixed with 3 to 12% copper nitrate and/or 4 to 14% silver nitrate.

Discolouration is also understood to mean a change of colour.

The transparent sheathing material can of course also be at least partially perforated or porous.

We claim:

1. In a method of producing cigarette filter units in which portions of fibrous filter material and of pourable filter material are serially disposed, the steps comprising:

arranging a series of fibrous filter portions at substantially uniform spaced apart intervals on a sheathing strip of substantially constant width equal to between 75% and 93% of the filter portion circumference, forming a continuous strand of filter portions by wrapping the sheathing strip around said series of said fibrous portions including the spaces therebetween and attaching said strip to said fibrous portions so as to define successive empty chambers between said fibrous portions and filler slots of substantially constant width extending the length of said chambers, conveying said strand under a suction zone having lateral walls, the undersides of which are in sealing and sliding relationship with the outsides of the two side edges of said sheathing strip, so that the said two side edges of said sheathing strip which define the filler slots, also define a suction slot along the length of said strand, evacuating air from each successive, in closed-off state, empty chamber of said strand by continuously applying suction to said chambers being in closed-off state through said suction slot, transferring said strand in closed-off state to a filling zone containing dispensable pourable filter material, the filling zone having lateral walls, the undersides of which are in sealing and sliding relationship with the outside of the two side edges of said sheathing strip, so that the chambers in said strand are maintained in closed-off state under reduced pressure until said chambers reach said filling zone and so that said filler slots pass beneath a filling port containing said pourable filter material where each of said evacuated chambers is opened to said filling port;

filling said chambers with said pourable filter material, said pourable filter material being drawn into said chambers through said filler slots due to the reduced pressure in said chambers, and sealing said suction slot with a sealing strip which is only slightly wider than the width thereof.

2. A method as claimed in claim 1, wherein each filter unit has a predetermined length, wherein said sheathing and sealing strips are transparent and wherein the step of sealing is performed so that the transparency of said sheathing and sealing strips is preserved along the entire length of said filter unit.

3. A method as claimed in claim 2, wherein the face of the sheathing and/or sealing strip whose side is in contact with the filter elements, is coated with thermoplastic material, and the strip or strips are secured by heating the thermoplastic material.

4. A method as claimed in claim 2, wherein prior to filling the spaces with pourable material, the sheathing strip is adhesively fixed to the fibrous portions, thus accurately defining the diameter of the cigarette filter unit which is to be produced.

5. A method as claimed in claim 2, and the further step comprising clearing the exposed areas of the fibrous filter portions between the two side edges of the sheathing strip and said two side edges of the sheathing strip of pourable material disposed in these regions after filling said chambers but before applying said sealing strip.

6. A method as claimed in claim 2, wherein a reduced pressure of at least 3 cm Hg is produced in the chambers which are to be filled.

7. A method as claimed in claim 2, wherein at least part of the pourable filter material includes a composition which will discolor under the influence of specific smoke constituents which are a health hazard for the smoker.

8. A method as claimed in claim 7, wherein said composition has the capacity to absorb such constituents.

9. A method as claimed in claim 2, wherein the pourable material is granular activated carbon which is colored or has a chemically non-injurious colored coating.

10. A method as claimed in claim 7, wherein the pourable material is friable filter material which contains an acid-base indicator which undergoes a color change under the influence of an acid or a base.

11. A method as claimed in claim 2, wherein the pourable material is a friable filter material which contains or consists of an oxidation catalyst which serves to oxidize carbon monoxide to carbon dioxide.

12. A method as claimed in claim 11, wherein anhydrous manganese dioxide is used as the oxidation catalyst.

13. A method according to claim 12, wherein the anhydrous manganese dioxide is mixed with 3 to 12% copper nitrate and/or 4 to 14% silver nitrate.

14. A method as claimed in claim 2, wherein the reduction of pressure is carried out by a suction device arranged in a passage which has a seal for sealing with the filter units so that the vacuum in the chambers is not lost as the units pass from the suction device to the filling zone, and wherein the length of the seal is greater than the length of the spaces between the fibrous portions.

15. A method as claimed in claim 14, wherein two different kinds of fibrous filter portions with different axial flow resistances are alternatively arranged in the sheathing strip, and the length of the seal as seen in the direction of movement of the sheathing strip amounts to at least $2a+2b+2c$, where a is the length of one kind of filter portion, b is the length of the other kind of filter portion, and c is the length of the space between the portions, and wherein said suction device defines a port positioned half way along the length of the seal.

16. A method as claimed in claim 15, wherein the length of the suction region is less than the length of the smaller of the filter portions in use.

17. A method as claimed in claim 7, wherein said composition is capable of combining chemically with said smoke constituents.

18. A method as claimed in claim 7, wherein said composition is also capable of converting said specific smoke constituents into constituents which are innocuous to health.

19. A cigarette filter unit produced by the method according to claim 2.

20. An apparatus for producing cigarette filter units in which portions of fibrous filter material and of pourable filter material are alternately disposed comprising, in a continuous production line, means for aligning and uniformly spacing a series of fibrous filter portions, a conveyor for feeding on one side of said fibrous portions a continuous filter sheathing strip of substantially constant width equal to between 75% and 93% of the circumference of said filter portions, wrapping means for wrapping said sheathing strip around the series of said fibrous portions so as to form a continuous cylindrical strand with empty chambers between adjacent fibrous portions and filler slots extending the length of said chambers defined by the two side edges of said sheathing strip, a continuous suction zone having lateral walls the length of said strand in sealing and sliding relationship to the other surface of said sheathing strip and forming a suction slot of substantially constant width defined by the two side edges of said sheathing strip and said lateral walls, and suction means for reducing the pressure in said chambers through said suction slot, a filling zone containing dispensable pourable filter material, conveying means for transporting said strand from said suction means to said filling zone, sealing means for maintaining the reduced pressure in said chambers while said strand is transferred from said suction means to said filling zone, so that said chambers open in said filling zone under reduced pressure causing said dispensable pourable filter material to be sucked into said chambers through said filler slots, and means for applying to said strand a sealing strip which is only slightly larger than the width of said suction slot to seal said strand.

21. An apparatus as claimed in claim 20, wherein said sheathing and sealing strips are transparent and wherein the means for applying said sealing strip preserves the transparency of said sheathing and sealing strips along the entire length of said filter unit.

22. Apparatus as claimed in claim 21, wherein the suction means has a plurality of ports opening into the suction zone and connected to a source of reduced pressure.

23. Apparatus as claimed in claim 21, and further including a brush between the filling zone and the sealing means for removing pourable filter material from the surfaces of the filter units which are free of the sheathing strip, and from surfaces which are associated with the sheathing strip and define the suction slot.

24. Apparatus as claimed in claim 21, wherein the brush is associated with an extraction device, for extracting the removed pourable material.

25. Apparatus according to claim 21, in which said suction zone and said filling zone are joined to each other through a common surface which has a slidable and sealable relationship to the exposed top sides of the filter portions not covered by said sheathing strip and wherein the suction slot is defined by lateral surfaces and the lateral edges of the sheathing strip.

26. Apparatus according to claim 21, which further comprises means for arranging alternately two different kinds of filter elements having different axial flow resistances on said sheathing strip and wherein the length of lateral surface in slidable relationship with said sheathing strip in the direction of movement of said sheathing strip amounts to at least $2a+2b+2c$ where a is the length of one kind of filter element, b is the length of the other kind of filter element and c is the length of said chamber and wherein ports of the suction device are positioned halfway along the length of said lateral surface.

27. A cigarette filter comprising portions of fibrous filter material and of pourable filter material serially disposed and produced by the steps of:

arranging a series of fibrous filter portions at substantially uniform spaced apart intervals on a sheathing strip of substantially constant width equal to between 75% and 93% of the filter portion circumference, forming a continuous strand of filter portions by wrapping the sheathing strip around said series of said fibrous portions including the spaces therebetween and attaching said strip to said fibrous portions so as to define successive empty chambers between said fibrous portions and filler slots of substantially constant width exceeding the length of said chambers, conveying said strand to a suction zone having lateral walls in sealing and sliding relationship with the outside of said sheathing strip, so that said walls, together with the two side edges of said sheathing strip which define the filler slots also define a suction slot along the length of said strand, reducing the pressure in the empty chambers of said strand by continuously applying suction to said strand through said suction slot, transferring said strand directly to a filling zone containing dispensable pourable filter material so that the chambers in said strand are maintained under reduced pressure until said strand reaches said filling zone and so that said filler slot pass beneath a filling port containing said pourable filter material, filling said chambers with said pourable filter material said pourable filter material being drawn into said chambers through said filler slots due to the reduced pressure in said chambers, successively releasing the reduced pressure in said chambers upon a respective chamber of said chambers reaching said filling zone, and sealing said suction slot with a sealing strip which is only slightly wider than the width thereof.

28. A cigarette filter according to claim 27, wherein said sheathing and sealing strips are transparent and wherein the means for applying said sealing strip preserves the transparency of said sheathing and sealing strips along the entire length of said filter unit.

29. In a method of producing cigarette filter units in which portions of fibrous filter material and of pourable filter material are serially disposed, the steps comprising:

arranging a series of fibrous filter portions at substantially uniform spaced apart intervals on a sheathing strip of substantially constant width equal to between 75% and 93% of the filter portion circumference, said sheathing strip having two outside edges, forming a continuous strand of filter portions by wrapping the sheathing strip around said series of said fibrous portions including the spaces therebetween and attaching said strip to said fibrous portions so as to define successive empty chambers between said fibrous portions and filler slots of substantially constant width extending the length of said chambers, each chamber having a closed-off state, conveying said strand near one side of a suction zone having lateral walls in sealing and sliding relationship with the outside edges of said sheathing strip, so that said walls, together with the two edges of said sheathing strip which define the filler slots, also define a suction slot along the length of said strand, reducing the pressure in each successive empty chamber of said strand by continuously applying suction to said strand through said suction slot, each of said empty chambers being in the closed-off state, transferring said strand and its chambers in their closed-off state directly to a filling zone containing dispensable pourable filter material, the filling zone including side walls having extremities in sealing and sliding relationship with the outside edges of said sealing strip, so that the chambers in said strand are maintained under reduced pressure in the closed-off state, until the chambers of said strand reach said filling zone, and so that said filler slots pass, and are juxtaposed to a filling port containing said pourable filter material, opening each of the chambers towards the filling port upon being juxtaposed thereto, so as to successively change the closed-off state of each chamber to an open state, filling said chambers with said pourable filter material, said pourable filter material being drawn into said chambers through said filler slots due to the reduced pressure in said chambers, and sealing said suction slot with a sealing strip which is only slightly wider than the width thereof.

30. In a method as claimed in claim 29, wherein said sealing and sheathing strips are transparent and wherein the step of sealing is pre-formed so that the transparency of said sheathing and sealing strips is preserved along the entire filter unit.

* * * * *